United States Patent [19]

Castonguay et al.

[11] 4,301,436

[45] Nov. 17, 1981

[54] CIRCUIT BREAKER HOOK APPARATUS

[75] Inventors: Roger N. Castonguay, Terryville; Charles L. Jencks, Avon, both of Conn.

[73] Assignee: General Electric Company, New York, N.Y.

[21] Appl. No.: 162,279

[22] Filed: Jun. 23, 1980

[51] Int. Cl.[3] ..... H01H 9/20; H01H 73/12

[52] U.S. Cl. ..... 335/166; 200/153 SC; 200/320; 335/26

[58] Field of Search ..... 335/20, 166, 26, 27, 335/28, 17, 167, 168, 169, 170, 171, 172, 173, 174, 175; 200/153 SC, 153 G, 153 H, 308, 320

[56] References Cited

U.S. PATENT DOCUMENTS 4,211,989 7/1980 Acampora ..... 200/308

4,220,936 9/1980 Powell ..... 335/166

4,245,140 1/1981 Jencks et al. ..... 200/153 SC 4,251,702 2/1981 Castonguay et al. ..... 200/153 SC

*Primary Examiner*—Harold Broome

*Attorney, Agent, or Firm*—Richard A. Menelly; Walter C. Bernkopf; Philip L. Schlamp

[57] ABSTRACT

Compound hook apparatus for intercepting and holding circuit breaker contacts in a hooked open position against the closing force of charged operating mechanism springs includes a primary hook releasably latching an intermediate hook in a hooking position to fixedly dispose a pin in intercepting relation with a hook cam carried by a breaker movable contact assembly. The primary hook is articulated to unlatch the intermediate hook, freeing the latter to thereby release the movable contacts from their hooked open position.

11 Claims, 10 Drawing Figures

CIRCUIT BREAKER HOOK APPARATUS

REFERENCE TO RELATED APPLICATIONS

The instant application is related to the commonly assigned, concurrently filed patent applications entitled Circuit Breaker Trip Latch Assembly Ser. No. 162,281 Flux Shifter Reset Assembly Ser. No 162,280 Undervoltage Release Reset and Lockout Apparatus Ser. No. 162,271 Circuit Breaker Electrical Closure Control Apparatus Ser. No. 162,278 and Circuit Breaker Condition Indicator Apparatus Ser. No. 162,282.

BACKGROND OF THE INVENTION

The present invention relates to industrial circuit breakers and particularly to apparatus for releasably holding the breaker movable contacts in a hooked open position to thereby store a closure motivating force in the breaker movable contact operating mechanism.

The subject hook apparatus has particular, but not necessarily limited application to a stored energy, reclosure type circuit breaker, such as that disclosed in commonly assigned, copending application, Ser. No. 52,276, filed June 25, 1979 now U.S. Pat. No. 4,251,702. The disclosure of this copending application is specifically incorporated herein by reference. As therein disclosed, a circuit breaker is provided with a movable contact operating mechanism whose springs, when charged, continuously impose a force biasing the movable contacts to their closed position so long as the mechanism cradle is latched in its reset position. In order to control the moment of breaker closure a hook is provided to releasably hold the movable contacts in a hooked open position, thus storing the closing force of the charged movable contact operating mechanism springs. When the hook is removed, the movable contacts spring to their closed position. To open the breaker, the breaker operating mechanism is tripped, i.e., the cradle is unlatched from its reset position, and the mechanism springs discharge to propel the cradle to a tripped position and the movable contacts to a tripped open position beyond their hooked open position.

To return the cradle to its latched reset position and, in the process charge the mechanism springs, a separate charging mechanism is utilized, as disclosed in the above-noted copending application. That is, a separate charging spring is charged and then discharged when the movable contacts achieved their tripped open position to abruptly return the cradle from its tripped position to its latched reset position. The mechanism springs are charged with equal abruptness, and the movable contacts are swiftly propelled from their tripped open position toward their closed position, developing considerable kinetic energy upon arrival at their hooked open position.

It is the responsibility of the hook to arrest this closing movement of the movable contacts upon arrival at their hooked open position, and the impact created in doing so is quite severe. Utilizing conventional hook design approaches, it was found that, with repeated such impacts, hook parts were readily broken, resulting in an unacceptably short useful life.

Accordingly, it is an object of the present invention to provide improved hook apparatus for holding the movable contacts of a circuit breaker in a hooked open position against the closing force of a charged movable contact operating mechanism.

Another object is to provide hook apparatus of the above character, which is capable of withstanding the high impact forces incident with arresting the closing motion of the movable contacts at their hooked open position.

A further object is to provide hook apparatus of the above character which accommodates a relatively light unhooking force and, once unhooked, is capable of quickly resetting itself to again stop the movable contacts in their hooked open position.

An additional object is to provide hook apparatus of the above character which is efficient in construction, reliable in operation, and exceptionally durable for long operating life.

Other objects of the invention will in part be obvious and in part appear hereinafter.

SUMMARY OF THE INVENTION

In accordance with the present invention, there is provided improved hook apparatus for arresting the closing movement of circuit breaker movable contacts upon their arrival at a hooked open position and for holding the movable contacts thereat against the closing force of a charged breaker operating mechanism until closure of the breaker is called for. To this end, the hook apparatus includes a primary hook, mounted for movement between a latching position and an unlatching position, and an intermediate hook mounted for movement between a hooking position and an unhooking position. In its latching position, the primary hook releasably latches the intermediate hook in its hooking position to fixedly position a hook element mounted thereby in intercepting relation with the movable contacts upon their arrival at their hooked open position en route to their closed position.

To release the movable contacts from their hooked open position, the primary hook is articulated to its unlatching position, freeing the intermediate hook for movement to its unhooking position, to which it is propelled as the movable contacts drive the hook element out of the way en route to their closed position.

More specifically, the intermediate hook is in the form of an elongated lever pivotally mounted intermediate its ends. The hook element takes the form of a roller pin mounted at one end of the intermediate hook lever, while a latch pin is mounted at the other end thereof. The primary hook is also pivotally mounted and is equipped with a notch into which the latch pin is lodged when the primary hook is in its latching position. This latching engagement fixes the intermediate hook lever in its hooking position with the roller pin in intercepting relation with an elongated hook cam carried by a movable contact assembly to stop the movable contacts in their hooked open position.

Externally induced pivotal movement of the primary hook to its unlatching position swings its notch out of engagement with the latch pin, freeing the intermediate hook lever and thus releasing the movable contacts from their hooked open position. As the intermediate hook lever is propelled to its unhooking position by the continuing engagement of the hook cam with the roller pin during closure movement of the movable contacts, the latch pin acts against a control edge of the primary hook, driving the latter to an extreme unlatching position where it is held while the movable contacts are in their closed position. In this position, the primary hook engageably conditions a trip latch assembly in preparation for subsequent tripping action thereof to effect opening movement of the movable contacts to a tripped open position beyond their hooked open position. With the movable contacts in their tripped open position, the hook cam releases the roller pin, and a reset spring biases the primary hook back to its latching position. In the process, the control edge of the primary hook picks up the latch pin to guide it back into the notch and thus reestablish the intermediate hook lever in its hooking position to await recharging of the operating mechanism and the arrival of the movable contacts at their hooked open position.

To accommodate manually induced closure of the breaker contacts, a manual close lever is provided in operative coupled relation with the primary hook, such that actuation of the former is translated into unlatching movement of the latter. In accordance with a feature of the invention, this coupling is effected via an intermediate bypass member which is, in turn, conditioned in response to the movement of the primary hook to its extreme unlatching position to decouple the manual close lever from the primary hook. Thus, the close lever can not interfere with the resetting of the primary and intermediate hooks, should the breaker, having been closed in on a fault, immediately be tripped open. Moreover, this decoupling enables the primary and intermediate hooks to successfuly intercept the movable contacts in their hooked open position despite sustained actuation of the manual close lever, should the operating mechanism be immediately recharged. Thus, inadvertent reclosure of the breaker back in on the fault is precluded. To recouple the manual close lever with the primary hook via the bypass member, the manual close lever is simply manually released to allow its movement to a quiescent position to which it is normally biased by a return spring.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings in which:

DESCRIPTION OF THE DRAWINGS

Corresponding reference numerals refer to like parts throughout the several views of the drawings.

DETAILED DESCRIPTION

Figure 1:
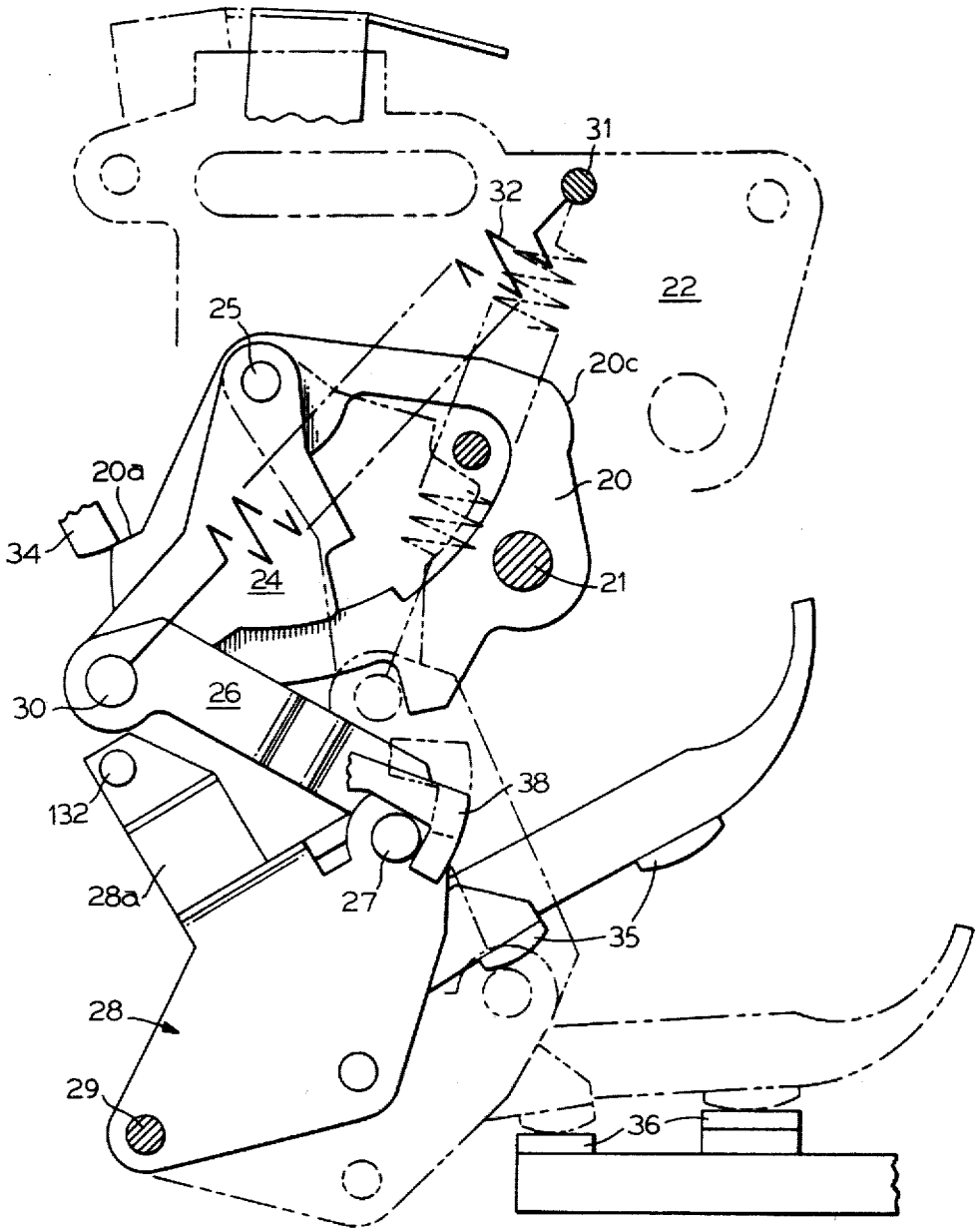
FIG. 1 is a side elevational view of a circuit breaker spring-powered movable contact operating mechanism.

Turning to the drawings, there is shown in FIG. 1, a circuit breaker movable contact operating mechanism corresponding to that disclosed in the above-noted copending application, Ser. No. 52,276. Thus, a cradle 20 is fixedly mounted on a pin 21 journalled by opposed mechanism frame sideplates 22. A toggle linkage consisting of an upper link 24 and a lower link 26 connects cradle 20 to a center pole movable contact assembly 28, pivotally mounted at 29. Specifically, the upper end of link 24 is pivotally connected to the cradle by a pin 25, while the lower end of link 26 is pivotally connected to the center pole movable contact assembly by a pin 27. The other ends of these toggle links are pivotally interconnected by a knee pin 30. Mechanism tension springs 32 act between the toggle knee pin and a stationary pin 31 supported between the frame sideplates 22.

From the description thus far, it will be noted that, by virtue of the position of spring anchoring pin 31, the line of action of the mechanism springs, while in their charged state by virtue of cradle 20 being in its latched reset position sustained by the engagement of a latch 34 with cradle latch shoulder **20*a*, is always situated to the right of the upper toggle link pivot pin 25. Thus, the mechanism springs continuously act to straighten the toggle. Since straightening of the toggle forces the movable contact assemblies 28, ganged together by crossbar 28*a*, to pivot downwardly to their phantom line, closed circuit position with their movable contacts 35 engaging stationary contacts 36, the circuit breaker is always biased toward contact closure while cradle 20** is latched in its reset position.

To control the moment of contact closure, a hook 38 engages pin 27 to hold movable contact assemblies 28 in a hooked open circuit position while the cradle is latched in its reset position and while it is being returned to its latched, reset position from a clockwisemost tripped position to charge the mechanism springs. Thus the toggle is maintained collapsed to the left as seen in FIG. 1. When the hook is removed, the movable contact assemblies 28 are pivoted to their closed circuit positions as springs 32 act to abruptly straighten toggle links 24, 26.

Figure 2:
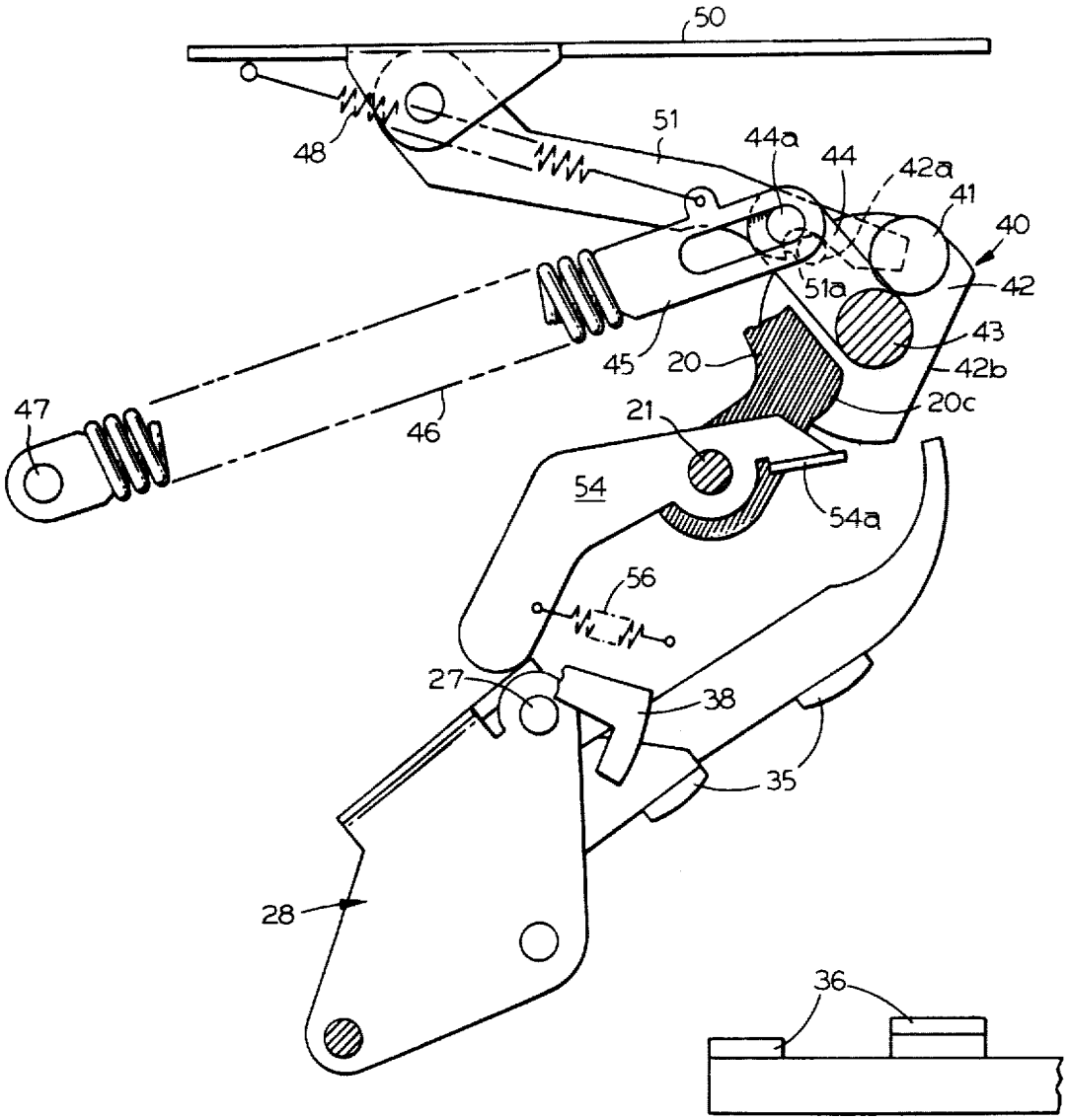
FIG. 2 is a simplified, side elevational view of a spring-powered charging mechanism utilized to charge the movable contact operating mechanism of FIG. 1.
Figure 3:
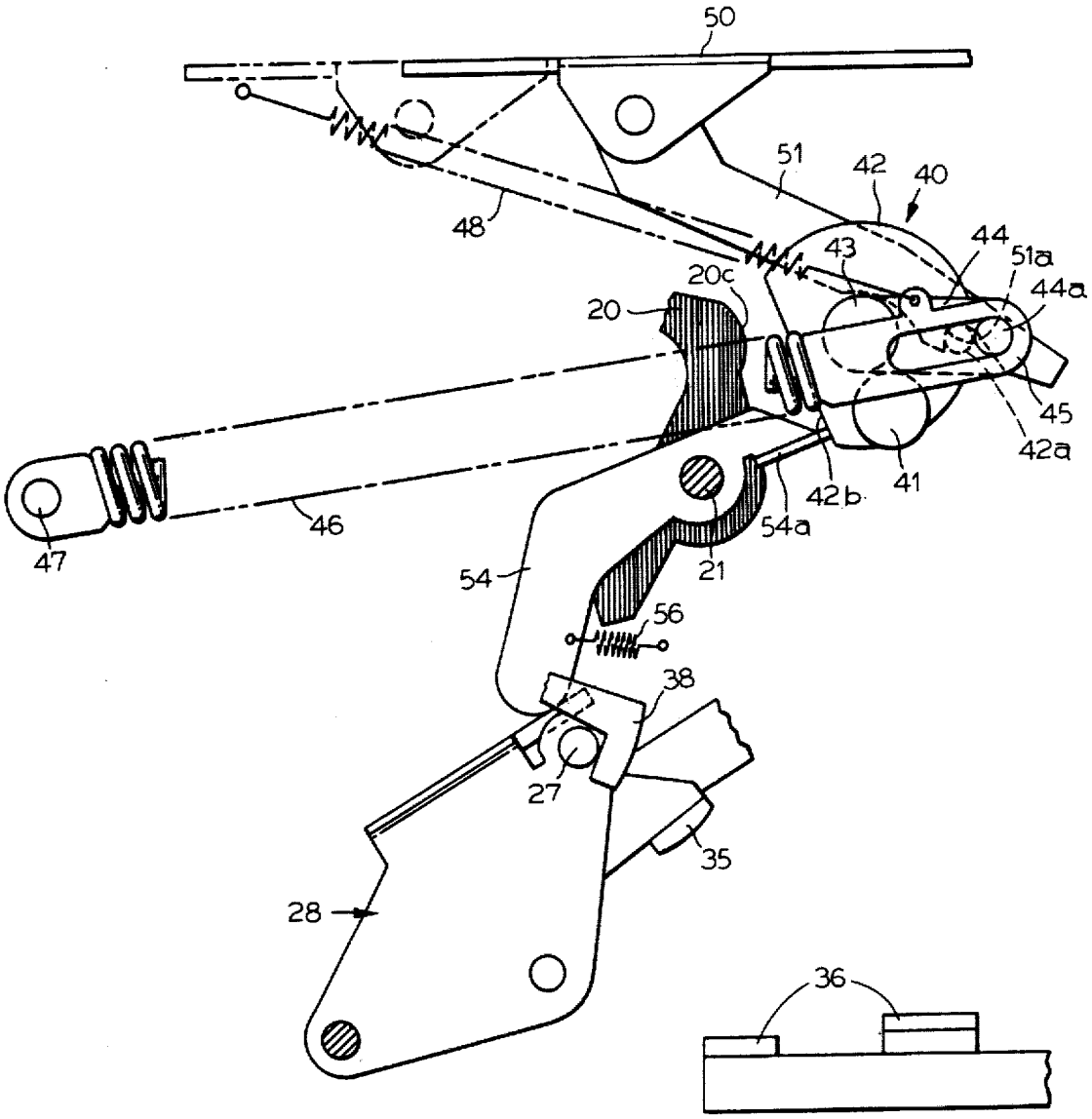
FIG. 3 is a simplified, side elevational view of the charging mechanism of FIG. 2 in its condition with a charge stored therein and while a charge is stored in the movable contact operating mechanism.
Figure 4:
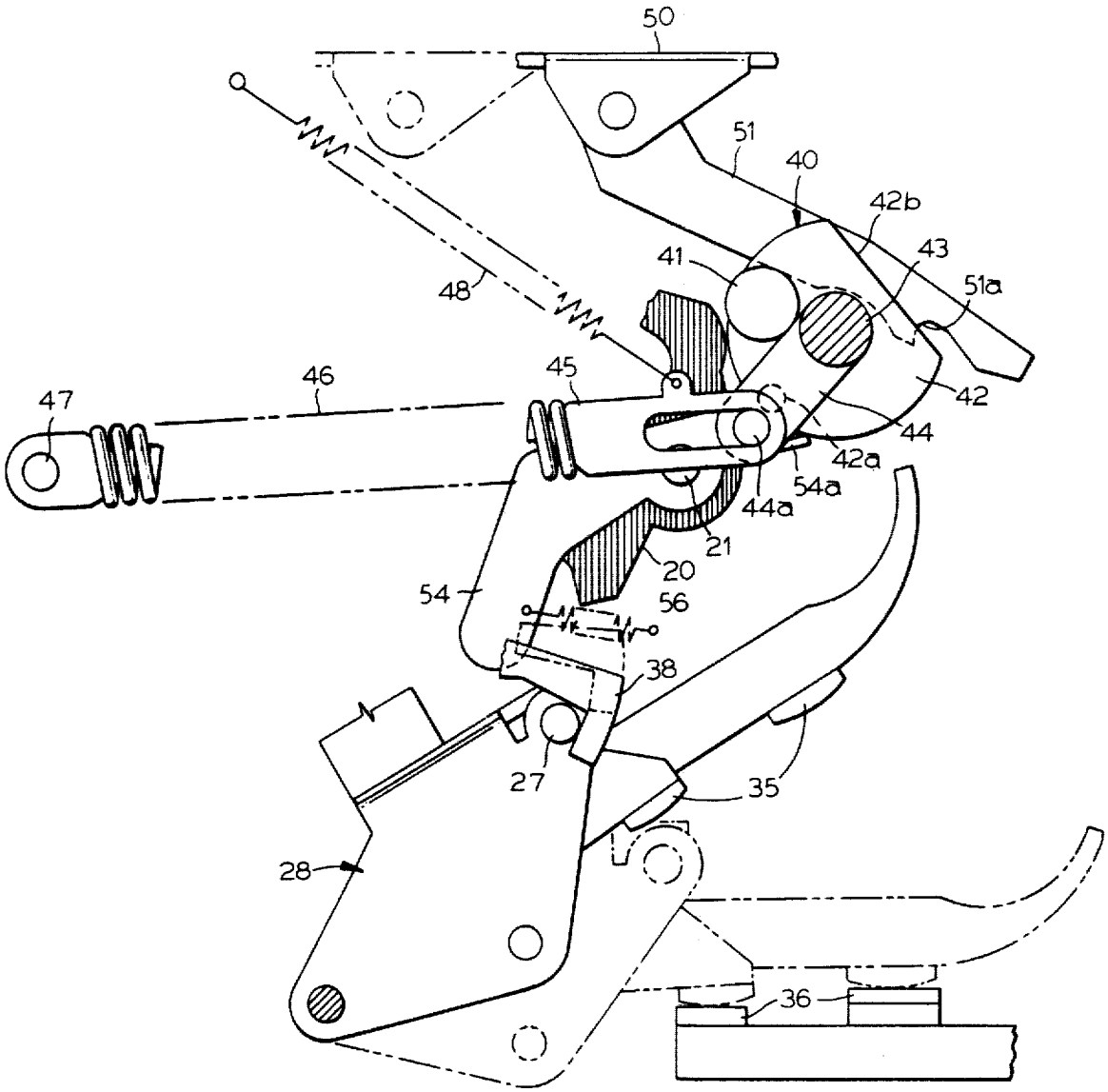
FIG. 4 is a simplified, side elevational view of the charging mechanism seen in its discharged condition while a charge is stored in the movable contact operating mechanism.

Reference is now had to FIGS. 2 through 4 for a review of the overall operation of the circuit breaker disclosed in the above-noted application, Ser. No. 52,276, and specifically the operation of a separate charging mechanism in charging the mechanism springs of the movable contact operating mechanism of FIG. 1. To induce counter-clockwise resetting pivotal movement of cradle 20, a bell crank assembly, generally indicated at 40, is provided with a reset roller 41 eccentrically mounted by a bell crank arm 42 carried by a shaft 43 journalled by the frame sideplates. Keyed to this shaft is an arm 44 which carries at its free end a pin 44*a* operating in an elongated slot in a spring anchor 45 secured to one end of a powerful tension spring 46. The other end of this spring is anchored to a stationary pin 47. As will be seen, when charging spring 46 discharges, bell crank assembly 40 is rotated clockwise to swing the reset roller around to engage a nose 20*c* of cradle 20, while in its tripped position, thereby driving the cradle in the counterclockwise direction to its latched reset position, in the process charging the contact operating mechanism springs 32 (FIG. 1).

Referring first to FIG. 2, bell crank assembly 40 is seen in its start angular orientation achieved by the action of a tension spring 48. An operator slide 50 is shown in its left-most return position with a pawl 51, pivotally connected thereto, retracted to a position where a notch 51*a* in its free end is in intercepting relation with an eccentric pin 42*a* carried by crank arm 42. From FIG. 3 it is seen that when slide 50 is propelled to the right through a breaker operating mechanism charging stroke, drive pawl 51 is pushed to the right. Its notch 51*a* picks up pin 42*a*, causing bell crank assembly 40 to be rotated in the clockwise direction. When the bell crank assembly reaches its angular position of FIG. 3, it is seen that charging spring 46 is stretched to a charged state. It is assumed, at this point in the description, that the movable contact operating mechanism of FIG. 1 is tripped, and thus cradle 20 is in its clockwise-most tripped position seen in FIG. 2. Under these circumstances, the essentially discharged contact operating mechanism springs 32 have lifted movable contact assemblies 28, to a counterclockwise-most tripped open position also seen in FIG. 2. In this position, the top surface of the center pole movable contact assembly engages and lifts the left lower end of a prop 54 pivotally mounted intermediate its ends by cradle pin 21. The upper end 54*a* of this prop is moved downwardly out of engaging relation with the arcuate surface portion of the bell crank arm against which it is normally engaged under the bias of a return spring 56.

As seen in FIG. 3, the rightward charging stroke of operator slide 50 is sufficient to carry the line of action of charging spring 46 through the axis of the bell crank assembly shaft 43. Consequently, with prop 54 in its FIG. 2 position, the charging spring immediately discharges and the bell crank assembly is thereby driven in the clockwise direction, swinging reset roller 41 into engagement with nose 20*c* of cradle 20 in its tripped position of FIG. 2. The cradle is thus swung in the counterclockwise direction to its reset position as the discharging springs 46 drive the bell crank assembly to its angular position seen in FIG. 4. As cradle 20 is being reset, contact operating mechanism springs 32 are charged to exert a bias tending to drive the movable contact assemblies 28 to their closed circuit positions seen in phantom in FIGS. 1 and 4. However, hook 38 is in position to intercept pin 27 and detain the movable contact assemblies in their hooked open position seen in FIGS. 3 and 4. By virtue of the loss motion coupling between bell crank assembly 40 and charging spring 46 afforded by the slot in spring anchor 45, spring 48 acts to continue the clockwise rotation of the bell crank assembly from its angular position of FIG. 4 around to its start position of FIG. 2 with pin 44*a* again bottomed against the right end of the spring anchor slot.

From the description thus far, it is seen that the first charge-discharge cycle of charging spring 46 has been effective in returning the contact operating mechanism cradle 20 to its latched reset position and charge springs 32 thereof, but the breaker contacts are sustained in their open circuit position by hook 38. At this point, the operator slide 50 can be motivated through a second rightward charging stroke to again charge spring 46. Since movable contact assemblies 28, in their hooked open position, have released prop 54, its upper end 54*a* rides on the arcuate surface portion of bell crank arm 42 as the bell crank assembly is rotated in a clockwise direction. Spring 56 elevates prop end 54*a* into intercepting relation with a flattened surface 42*b* of bell crank arm 42 at the conclusion of the operator slide charging stroke just as the line of action of the charging spring 46 passes below the axis of bell crank assembly shaft 43. Thus, as seen in FIG. 3, prop 54 serves to prevent further clockwise rotation of bell crank assembly 40, and the charging spring 46 is held in a fully charged condition. It is thus seen that while the breaker contacts are held in their hooked open circuit position by hook 38, both the charging spring 46 and contact operating mechanism springs 32 are poised in their fully charged conditions. At this point, hook 38 may be articulated to release the movable contact assemblies 28, whereupon they pivot to their closed circuit position under the urgence of mechanism springs 32. It will be noted that closure of the movable contacts has no effect on prop 54, and thus charging spring 46 is sustained in its fully charged condition.

When the circuit breaker is eventually tripped open by removal of latch 34 (FIG. 1), the unlatched cradle 20 swings clockwise to its tripped position, and the movable contact assemblies abruptly pivot upwardly to their tripped open position of FIG. 2, all under the urgence of the discharging contact operating mechansim springs 32. As the center pole movable contact assembly moves to its tripped open position, it picks up the lower end of prop 54, ducking its upper end out of engagement with the flat peripheral surface 42*b* of crank arm 42. The clockwise rotational restraint on the bell crank assembly is thus removed, and charging spring 46 abruptly discharges, swinging reset roller 41 around to drive cradle 20 from its tripped position of FIG. 2 back to its reset position of FIG. 3. The contact operating mechanism springs 32 are again charged, and the movable contact assemblies 28 move to their hooked open position seen in FIG. 4. At this point, the charging spring 46 may again be charged to create the condition depicted in FIG. 3, and the charge therein will be automatically stored by prop 54 until needed to recharge the contact operating mechanism springs 32. Alternatively, and more significantly, hook 38 may be articulated to precipitate closure of the breaker, and thereafter the breaker may be tripped open without charging the charging spring 46.

From the foregoing description, it is seen that with the breaker contacts open and its contact operating mechanism tripped, the charging spring can be put through a first charge-discharge cycle to charge the contact operating mechanism springs 32 and then a second charge which is stored by prop 54 until needed to re-charge the mechanism springs. Thus, the circuit breaker, starting in its tripped open condition and with two chargings of charging spring 46, can be, in sequence, closed, tripped open, reclosed and tripped open again without an intervening charging of the charging spring. It follows from this that the charging spring can be charged with the breaker contacts closed to achieve, in sequence, opening, closing and opening operations of the circuit breaker without an intervening charge.

Figure 5:
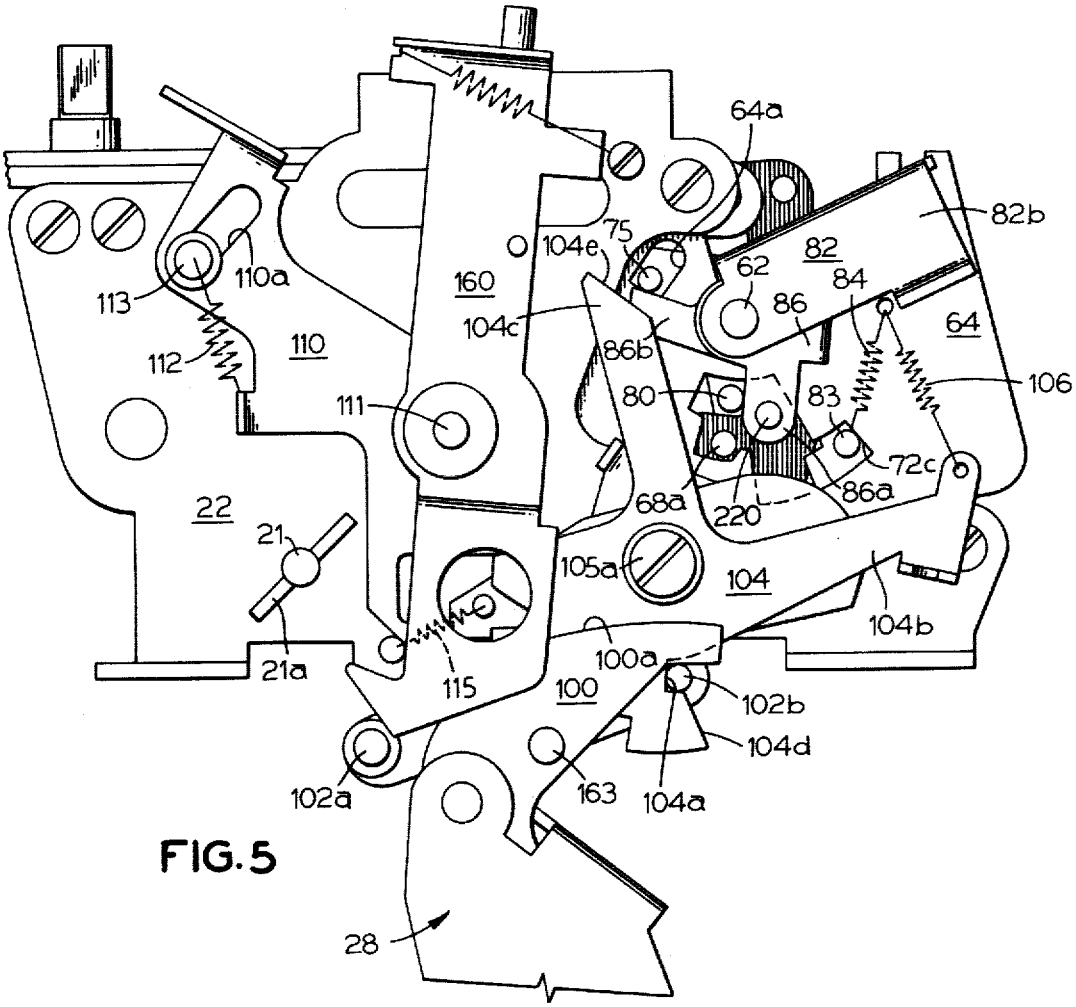
FIG. 5 is a side elevational view of an industrial circuit breaker showing releaseable hook apparatus for holding the breaker movable contacts in their hooked open position of FIG. 3.
Figure 6:
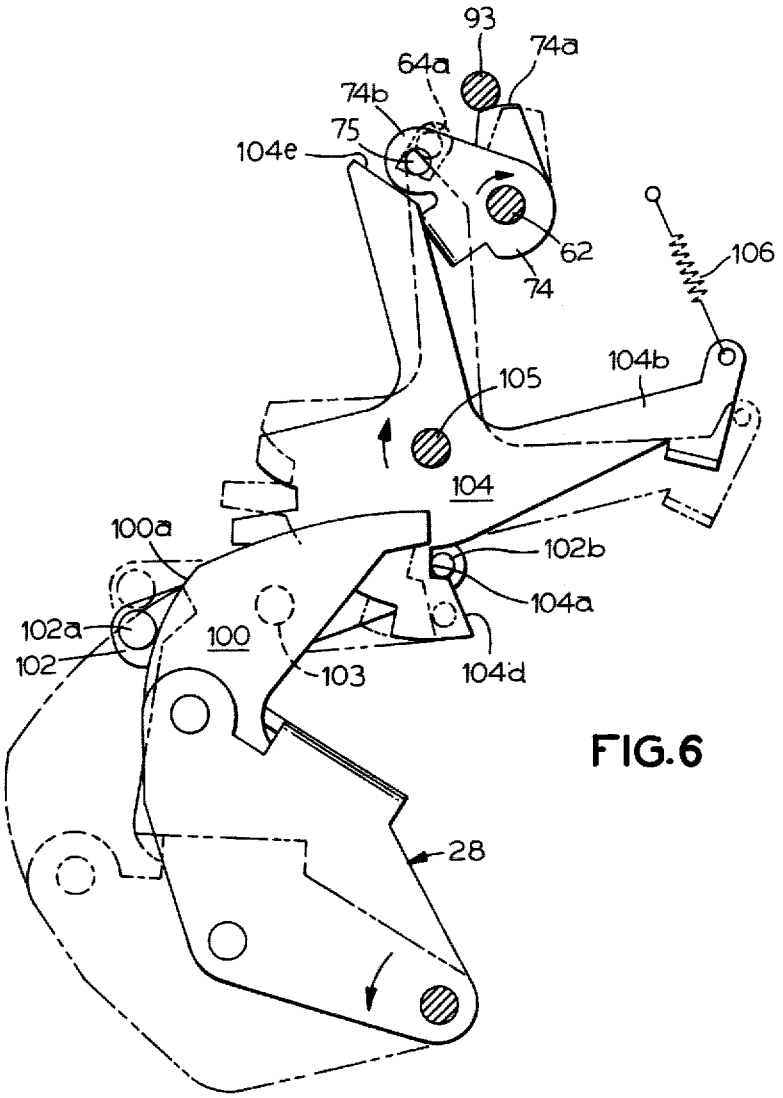
FIG. 6 is a simplified side elevational view of the hook apparatus of FIG. 5, illustrating its release of the breaker movable contacts from their hooked open position.

To contend with the high impact forces incident with stopping the movable contact assemblies 28 in their hooked open position of FIG. 1 as they spring from their tripped open position of FIG. 2 toward their closed circuit position while mechanism springs 32 are charged, a more elaborate hook arrangement than the simple hook 38 was necessitated. To this end, as seen in FIGS. 5 and 6, a cam plate 100, presenting an elongated, compound arcuate cam edge 100*a*, is mounted by the center pole movable contact assembly. This cam edge engages a roller pin 102*a* carried at the left end of an intermediate hook level 102 which is pivotally mounted intermediate its ends on a pin 103 mounted by one of the mechanism frame sideplates 22. The other end of this intermediate hook lever carries a latch pin 102*b* which is latchably received in a notch 104*a* provided in a primary hook lever 104 which is pivotally mounted by a hub 105 (FIG. 6); this pivotal mounting being preserved by a screw 105*a* (FIG. 5). This primary hook lever includes a generally horizontally extending actuating arm 104*b* and an upstanding actuating finger 104*c*. A tension spring 106 biases the primary hook lever to a counterclockwise-most latching position with latch pin 102*b* of the intermediate hook lever lodged in notch 104*a*.

FIG. 5 depicts the movable contact assemblies in their tripped open position assumed when mechanism springs 32 (FIG. 1) are completely discharged. Under these circumstances, cam edge 100*a* is disengaged from roller pin 102*a* of intermediate latch lever 102. When, during the return of cradle 20 from its tripped position by the discharge of charging spring 46 (FIG. 4) pursuant to charging mechanism springs 32, the line of action of the mechanism springs moves to the right of toggle pivot pin 26 (FIG. 1) and the mechanism springs become empowered to straighten the toggle. The movable contact assemblies are thus abruptly propelled from their tripped open position toward their closed circuit position. This closing movement is arrested at the hooked open position when cam edge 100*a* impacts with roller pin 102*a* of intermediate hook lever 102. Since latch pin 102*b* is lodged in primary hook notch 104*a*, the clockwise movement exerted on the intermediate hook lever by the charging mechanism springs is resisted, and the movable contact assemblies are readily arrested in their hooked open position, seen in solid line in FIG. 6, while the cradle is being re-latched in its reset position.

To now unhook the movable contact assemblies for closure under the urgence of the fully charged mechanism springs, primary hook 104 is simply pivoted from its latching position in the clockwise direction to its unlatching position seen in phantom line in FIG. 6. This pivotal movement, which may be induced by a closing solenoid (not shown) acting on primary hook actuating arm 104*b*, disengages latch pin 102*b* from notch 104*a*. The clockwise pivotal restraint on intermediate hook 102 is thus removed, thereby unhooking the movable contact assemblies for movement to their closed circuit position under the urgence of the charged mechanism springs 32. During this closure movement, cam 100 propels intermediate hook 102 through an increment of clockwise rotation to an unhooking position. In the process, latch pin 102*b* acts on a sloping edge 104*d* of primary hook 104 beneath notch 104*a* to propel the primary hook through an increment of clockwise pivotal movement in addition to and independent of the closure initiating action on the primary hook in initially dislodging latch pin 102*b* from notch 104*a*. During this additional increment of clockwise primary hook pivotal movement to an extreme unlatching position induced solely by the closing movement of the movable contact assemblies, the upper edge 104*e* of primary hook finger 104*c* picks up pin 75 carried by a secondary latch 74 of a trip latch assembly which is disclosed in detail in the above-noted related application entitled Circuit Breaker Trip Latch Assembly. This secondary latch is thus rotated in the clockwise direction seen in FIG. 6 to swing its prop 74*a* out from under an intermediate latch pin 93 of the trip latch assembly.

As is described in this related application, whose disclosure is specifically incorporated herein by reference, secondary latch 74 is pivoted from its latching position to its unlatching position incident with the closure of the breaker contacts so as to then qualify a second secondary latch to initiate removal of primary latch 34 from candle shoulder 20*a* (FIG. 1) pursuant to tripping the breaker. It is seen that this action is achieved by primary hook 104 acting in response to closure movement of the movable contact assemblies communicated thereto by cam 100 and intermediate hook 102. Preferably, the geometry of primary hook 104 is such that secondary latch pin 75 is not picked up until latch pin 102*b* is irretrievably dislodged from notch 104*a*. Thus, secondary latch 74 cannot be removed by the externally induced pivotal movement of the primary hook to initiate unhooking of the movable contact assemblies, but only when the movable contact assemblies are committed to closure. This precludes so-called "crashing" of the breaker operating mechanism while the movable contact assemblies are in their hooked open position by the spurious removal of both secondary latches of the trip latch assembly.

While the movable contact assemblies remain in their closed circuit position, cam 100 maintains intermediate hook 102 and primary hook 104 in their phantom line positions of FIG. 6 and secondary latch 74 is thus held in its phantom line removed or unlatching position to sustain the qualification of the second secondary latch to initiate tripping of the breaker. When the breaker is tripped, the movable contact assemblies spring to their trip open position where cam 100 releases intermediate hook 102, as seen in FIG. 5. Spring 106 is then free to pivot primary hook 104 in the counterclockwise direction back to its latching position. In the process, edge 104*d* thereof, acting on latch pin 102*b*, cams intermediate hook 102 in the counterclockwise direction to a hooking position where the latch pin is re-engaged in notch 104*a*. At the same time, primary hook finger 104*c* is displaced from pin 75, freeing secondary latch 74 for return to its latching position to which it is spring biased, which is effective to reset the trip latch assembly, again as detailed in the related trip latch assembly application. From FIG. 2 it will be recalled that prop 54 is not removed to initiate recharging of the mechanism springs 32 (FIG. 1) until the movable contact assemblies substantially achieved their tripped open position. Consequently, the resettings of the trip latch and the primary and intermediate hooks are affected essentially before recharging of the mechanism springs begins.

Figure 9:
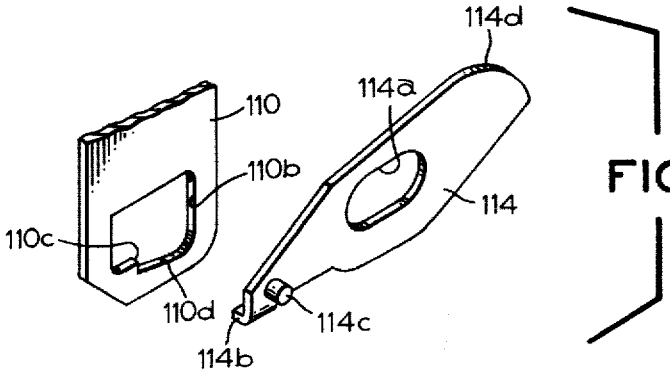
FIG. 9 is an exploded perspective view depicting the coupling relationship between a manual close lever and a bypass lever in the hook apparatus of FIG. 5.
Figure 7:
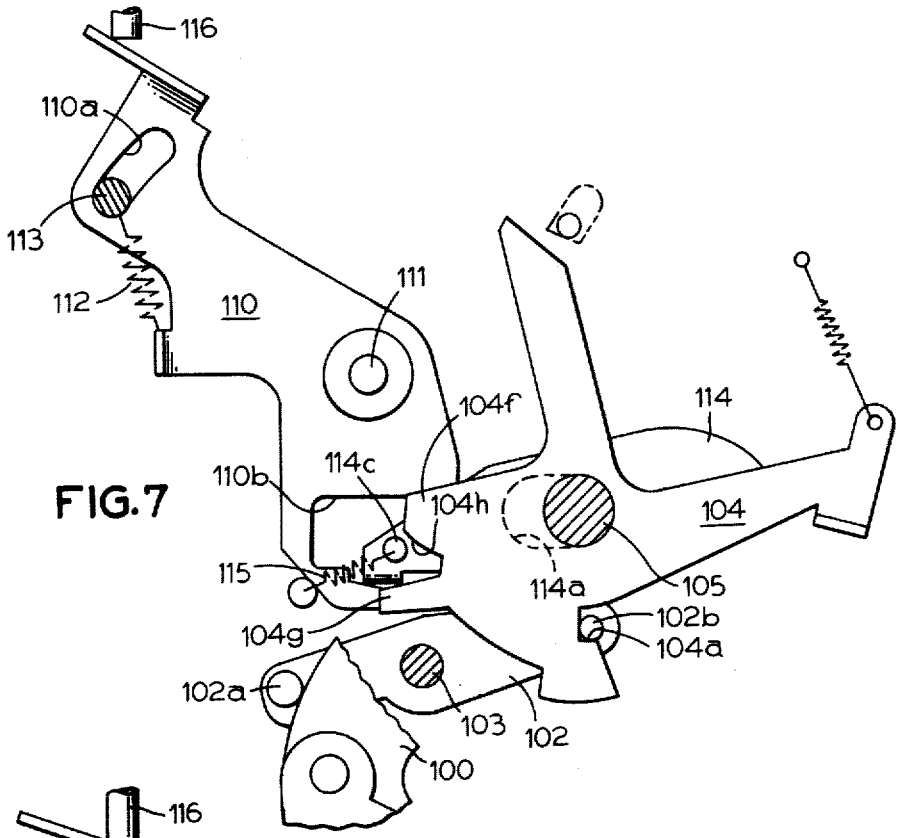
FIG. 7 is a side elevational view of the hook apparatus of FIG. 5 in its condition holding the movable contacts in their hooked open position.
Figure 8:
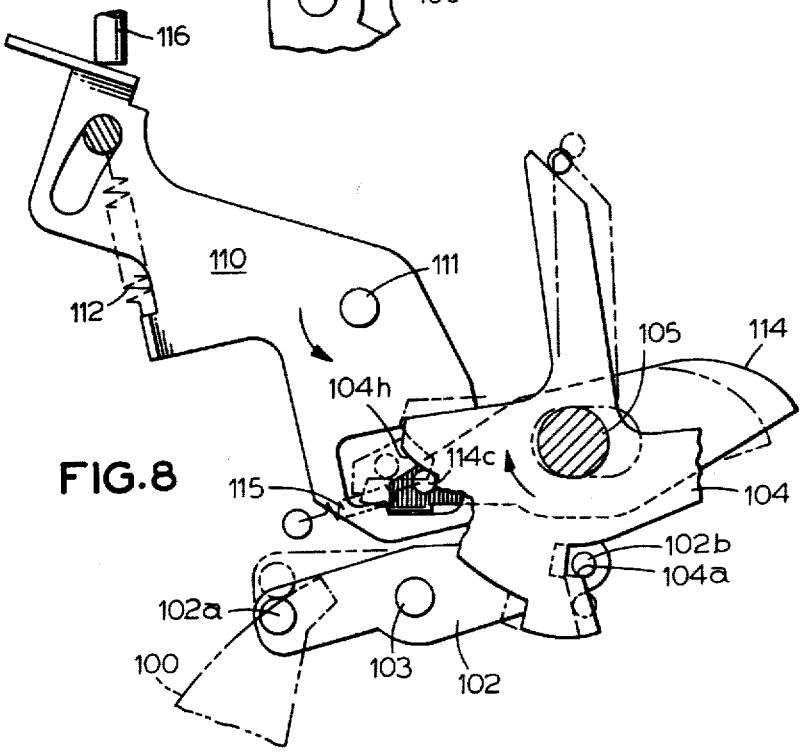
FIG. 8 is a side elevational view of the hook apparatus of FIG. 5 illustrating manually initiated release of the movable contacts from their hooked open position.

In addition to breaker closure being initiated by a closing solenoid acting on primary hook actuating arm 104*b*, breaker closure may also be initiated manually. To this end a close lever 110 is pivotally mounted to one of the mechanism frame sideplates by a pin 111, as seen in FIGS. 5, 7 and 8. A spring 112 biases this close lever to a clockwise-most quiescent position determined by the bottoming of a stationary pin 113 in a lever slot 110*a*. The lower end of close lever 110 is provided with a cutout 110*b* in which is created a shoulder 110*c*, as best seen in FIG. 9. An elongated bypass lever 114 is formed having an intermediate slot 114*a* in which is received hub 105, to both rotatably and slideably mount same, as seen in FIGS. 7 and 8. A tension spring 115 normally biases bypass lever 114 to a left-most position, seen in FIG. 7, determined by the bottoming of hub 105 against the right end of slot 114*a*. Spring 115 also normally biases the bypass lever to its counterclockwise-most position determined by the engagement of a laterally turned tab 114*b* thereof with an edge portion 110*d* of cutout 110*b* in close lever 110 (FIGS. 7 through 9).

The left end of primary hook 104, as best seen in FIG. 7, is provided with a protruding nose 104*f* and lip 104*g*. A pin 114*c*, carried at the left end of bypass lever 114, acts on the arcuate lower edge 104*h* of nose 104*f* to initiate unlatching, clockwise pivotal movement of primary hook 104 in response to counterclockwise pivotal movement of close lever 110 induced by depression of a close pushbutton 116 provided in the breaker cover (not shown). Specifically, counterclockwise pivotal movement of the close lever swings its lower end rightward, and cutout shoulder 110*c* picks up tab 114*b* to shift bypass lever 114 rightward. Pin 114*c* thereof moves into engagement with arcuate edge 104*h*, camming the primary hook through an increment of clockwise rotation sufficient to dislodge latch pin 102*b* from notch 104*a*. The movable contact assemblies thus become unhooked and spring closed, incidentally pivoting intermediate hook 102 clockwise to impart an additional increment of clockwise rotation to the primary hook sufficient to remove secondary latch 74, all as previously described. Also incident with this additional increment of primary hook clockwise rotation, lip 104*g* swings upwardly to pick up pin 114*c* and lift the left end of bypass lever 114 sufficiently to elevate tab 114*b* above shoulder 110*c* in the close lever cutout 110*b*, as seen in phantom in FIG. 8. Spring 115 then acts to return the bypass lever to its left-most position.

Under these circumstances, it is seen that close lever 110 is decoupled from primary hook 104 in the sense that continued depression of close button 116 to sustain the close lever in its angular position of FIG. 8 can not prevent resetting of the primary and intermediate hooks when the breaker is tripped open and the movable contact operating mechanism then immediately recharged by the charging mechanism (FIGS. 3 and 4). Thus, if the breaker is closed by articulation of the close lever and is immediately tripped open because of a sensed fault condition, highly undesirable reclosure back into the fault if the operating mechanism is immediately recharged, is not permitted simply because depression of close pushbutton 116 is inadvertently continued. Since sustained close button depression does not prevent resetting of the primary and intermediate hooks, the movable contact assemblies are held in their hooked open position and thus can not close back in on the fault. To reset the bypass lever, the close pushbutton must be released to permit the close lever to return to its clockwise-most position under the bias of spring 112. This swings cutout shoulder 110*c* to the left of tab 114*b*, whereupon spring 115 swings the left end of the bypass lever downwardly to abut its tab against cutout edge 110*d* where it once again can be picked up by shoulder 110*c*. It is thus seen that, by virtue of bypass lever 114, a single depression of close pushbutton 116 can initiate but one breaker closure.

Bypass lever 114 is also utilized in conjunction with a trip lever 82, described in the above-mentioned related trip latch assembly application, to decouple close lever 110 from primary hook 104. As seen in FIG. 5, this trip lever is normally biased by a tension spring 84 to a counterclockwise-most position determined by the abutment of a pin 83 carried thereby with edge portion 72*c* of cutout 72 provided in sideplate 64. From FIG. 10, it is seen that clockwise pivotal movement of trip lever 82 induced, for example, by depression of a breaker cover mounted open pushbutton 121, causes a trip lever edge portion 82*d* to pick up pin 80 carried by the trip initiating secondary latch of the trip latch assembly pursuant to pivoting it to its trip precipitating unlatching position effecting removal of primary latch 34 (FIG. 1). In numerous applications, various forms of interlocking such as Kirk Key, breaker padlocking, drawout interlocking, are called for to prevent unauthorized manual closure of the circuit breaker. Typically, this is accomplished by defeating the cradle latch so that the breaker operating mechanism can not be charged. Since a discharged operating mechanism is incapable of closing the breaker movable contacts, effective interlocking is achieved. Since the trip latch assembly disclosed in the above-mentioned related application includes two secondary latches, each capable of sustaining a charge in the operating mechanism springs, both should be defeated to render the breaker incapable of being charged and subsequently closed by depression of the close pushbutton. However, this is not a desirable approach for the subject breaker construction since it is essential that trip lever 82 be completely divorced from secondary latch 74 so that the latter can be independently and quickly reset to hold the charge imparted to the mechanism springs by the charging springs immediately after the other secondary latch has been removed by the trip lever to trip the breaker open. Otherwise, prolonged depression of the open pushbutton would cause the breaker operating mechanism to "crash" when the mechanism springs are recharged.

Figure 10:
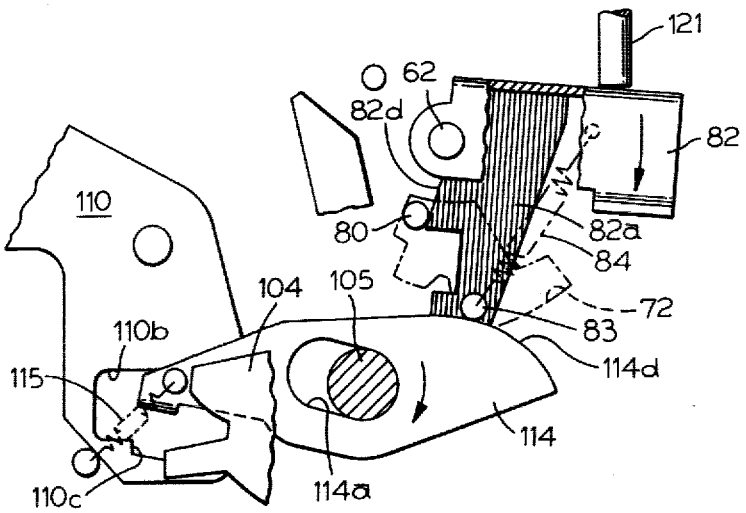
FIG. 10 is a fragmentary side elevational view illustrating the action of an externally applied interlock in defeating manual release of the movable contacts from their hooked open position.

Consequently, to accomodate such interlocking in the subject circuit breaker construction, trip lever 82 is held in its clockwise-most position seen in FIG. 10 by an external interlock actuating member (not shown) acting directly on the trip lever or on open pushbutton 121 to sustain its depression. The trip initiating secondary latch is thus held in its unlatching position. More significantly however, pin 83, carried at the lower end of trip lever leg 82*a* and projecting through frame sideplate cutout 72, is swung into engagement with an arcuate edge segment 114*d* of bypass lever 114. This causes the bypass lever to be rotated in the clockwise direction to lift and hold tab 114*b* in elevated, disengaged relation with cutout shoulder 110*c* of close lever 110. It is seen that, under these circumstances, the close lever is decoupled from primary hook 104, and thus the capability to manually initiate closure of the breaker by the close pushbutton is defeated. Yet, the mechanism springs can be charged and, in fact, prop 54 (FIG. 3) is available to store a charge in charging spring 46. Thus, the breaker stands ready to be closed once the interlock is removed, i.e., trip lever 82 is restored to its counterclockwise-most position by return spring 84.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. Hook apparatus for releasably holding the movable contacts of a circuit breaker in a hooked open position against the force of a charged mechanism spring acting to propel the movable contact assemblies to a closed position; said hook apparatus comprising, in combination:

A. a hook cam carried by the movable contact assemblies;

B. an intermediate hook in the form of a lever pivotally mounted intermediate its ends for movement between hooking and unhooking positions;

C. a hook pin mounted adjacent one end of said lever;

D. a latch pin mounted adjacent the other end of said lever; and

E. a primary hook mounted for movement between latching and unlatching positions, said primary hook including latching means for engaging said latch pin to latch said lever in its hooking position such as to fixedly position said hook pin in interfering relation with the edge of said hook cam and thus intercept and hold the movable contact assemblies in their hooked open position, upon movement of said primary hook to its unlatching position, said latching means disengages said latch pin, freeing said lever for movement to its unhooking position and releasing the movable contact assemblies from their hooked open position.

2. The hook apparatus defined in claim 1, wherein said hook cam edge is elongated such as to engage said hook pin and thereby propel said intermediate hook lever to its unhooking position as the movable contact assemblies spring to their closed position, said hook cam holding said intermediate hook lever in its unhooking position while the movable contact assemblies are in their closed position, and said primary hook includes a control edge engaged by said latch pin to propel said primary hook to an extreme unlatching position incident with the propulsion of said intermediate hook lever to its unhooking position by said hook cam, said primary hook being held in its unlatching position while said intermediate hook lever is held in its unhooking position.

3. The hook apparatus defined in claim 2, which further includes a return spring biasing said primary hook to its latching position when the breaker is tripped and the movable contact assemblies spring from their closed position to a tripped open position beyond said hooked open position as the mechanism spring discharges, said primary hook control edge engaging said latch pin to cam said intermediate hook lever to its hooking position with said latch pin engaged by said latching means to fixedly position said hook pin in interfering relation with said hook cam when the mechanism spring is subsequently charged and the movable contact assemblies spring from their tripped open position to their hooked open position.

4. The hook apparatus defined in claim 3, wherein said latching means is in the form of a notch formed in an edge of said primary hook, said control edge being located adjacent said notch.

5. The hook apparatus defined in claim 3, which further includes a manually operable closure initiating member mounted for movement between a deactuated position and an actuated position, the manually induced movement of said member to its actuated position being coupled to said primary hook to induce unlatching movement thereof sufficient to disengage said latching means from said latch pin.

6. The hook apparatus defined in claim 5, which further includes a bypass member coupling the actuating movement of said closure member to said primary hook such as to induce unlatching movement thereof.

7. The hook apparatus defined in claim 6, wherein said bypass member includes means engaged by said primary hook as the latter is propelled to its unlatching position such as to orient said bypass member from a manual closure enabling position to a manual closure disabling position effective to decouple said closure initiating member from said primary hook while said closure initiating member is sustained in its actuated position, whereby said primary hook and said intermediate hook lever are free to return to their respective latching and hooking positions when the movable contact assemblies spring to their tripped open position despite the retention of said closure initiating member in its actuated position.

8. The hook assembly defined in claim 7, wherein said closure initiating member includes means for holding said bypass member in its manual closure disabling position while said closure initiating member is sustained in its actuated position.

9. The hook assembly defined in claim 8, which further includes means biasing said bypass member to its manual closure enabling position when said closure initiating member is returned to its de-actuated position, whereby to recouple said closure initiating member with said primary hook via said bypass member.

10. The hook assembly defined in claim 9, which further includes a manual closure interlock member selectively operable to orient and hold said bypass member in its manual closure disabling position against the bias of said biasing means.

11. The hook assembly defined in claim 10, wherein said primary hook includes means operable to condition a breaker trip latch assembly in accordance with the position of said primary hook.

* * * * *